US009255370B2

(12) United States Patent
Paonessa

(10) Patent No.: US 9,255,370 B2
(45) Date of Patent: Feb. 9, 2016

(54) SNOW PLOW FOR ADJUSTING TO SURFACE CONTOURS AND OBSTACLES

(71) Applicant: Adepco Technologies Corp., Burlington, Ontario (CA)

(72) Inventor: Gino Paonessa, Oakville (CA)

(73) Assignee: Adepco Technologies Corp. (CA)

( * ) Notice: Subject to any disclaimer, the term of this patent is extended or adjusted under 35 U.S.C. 154(b) by 0 days.

(21) Appl. No.: 14/331,224

(22) Filed: Jul. 14, 2014

(65) Prior Publication Data

US 2014/0317966 A1 Oct. 30, 2014

Related U.S. Application Data

(60) Division of application No. 13/136,340, filed on Jul. 29, 2011, now Pat. No. 8,776,405, which is a continuation-in-part of application No. 13/180,158, filed on Jul. 11, 2011, now abandoned, which is a (Continued)

(51) Int. Cl.
*E01H 5/04* (2006.01)
*E01H 5/06* (2006.01)

(52) U.S. Cl.
CPC . *E01H 5/06* (2013.01); *E01H 5/062* (2013.01)

(58) Field of Classification Search
CPC ..... E02F 3/3631; E02F 3/3672; E02F 3/3645; E01H 5/06; E01H 5/066; E01H 5/04; E01H 5/063; E01H 5/061
USPC ..... 37/231–233; 172/272–275, 261, 265, 172/705; 280/477; 414/722–724
See application file for complete search history.

(56) References Cited

U.S. PATENT DOCUMENTS 2,231,875 A 2/1941 Behnke et al.
2,722,064 A * 11/1955 Adolf et al. ..... 37/231

(Continued)

FOREIGN PATENT DOCUMENTS

CA 2570985 6/2008
CA 2600003 2/2009

(Continued)

OTHER PUBLICATIONS

Sectional Sno-Plow Light Duty Parts Manual, Arctic Incorporated, http://sectionalplow.com/; last accessed on XXX.

(Continued)

*Primary Examiner* — Robert Pezzuto
(74) *Attorney, Agent, or Firm* — Steve Greenberg; CRGO Law

(57) ABSTRACT

A snow plow includes a plurality of surface-engaging sections movably carried by the moldboard and depending from the moldboard in side-by-side relationship with one another. The surface-engaging sections are each independently linearly movable relative to the moldboard between an extended position and a retracted position to adjust to the contour of the surface being plowed. Each surface-engaging section comprises a main body portion carried by the moldboard, and a surface-engaging trip blade portion carried by the main body portion and which can pivot between a surface-scraping position and a deflected position and is urged toward the surface-scraping position. The trip blade portion can deflect to accommodate obstacles, and can cooperate with the linear movement of the surface-engaging sections to accommodate larger obstacles than can be accommodated by deflection alone. The snow plow also includes adjustable wear shoes and an adjustable vehicle mounting assembly.

7 Claims, 20 Drawing Sheets

Related U.S. Application Data continuation-in-part of application No. 12/395,691, filed on Mar. 1, 2009, now Pat. No. 7,975,409, which is a continuation-in-part of application No. 11/600,804, filed on Nov. 17, 2006, now Pat. No. 7,555,853.

(56) References Cited

U.S. PATENT DOCUMENTS

| | | | | |
|---|---|---|---|---|
| 2,962,821 | A | 12/1960 | Peitl | |
| 3,470,631 | A | 10/1969 | Grimes | |
| 3,483,642 | A | 12/1969 | Glesmann | |
| 3,760,883 | A | 9/1973 | Birk | |
| 4,596,081 | A * | 6/1986 | DeBilly et al. | 37/281 |
| 4,669,205 | A | 6/1987 | Smathers | |
| 4,794,710 | A | 1/1989 | Haring | |
| 4,944,104 | A | 7/1990 | Kowalczyk | |
| 5,109,618 | A | 5/1992 | Grubler et al. | |
| 5,142,801 | A * | 9/1992 | Feller | 37/235 |
| 5,437,113 | A | 8/1995 | Jones | |
| 5,509,219 | A | 4/1996 | Mecca | |
| 5,697,172 | A | 12/1997 | Verseef | |
| 5,743,032 | A | 4/1998 | Vauhkonen | |
| 5,819,443 | A | 10/1998 | Winter | |
| 5,894,689 | A | 4/1999 | Turk | |
| 6,240,660 | B1 | 6/2001 | Dugas | |
| 6,817,118 | B2 | 11/2004 | Schmeichel | |
| 6,823,615 | B2 | 11/2004 | Strait | |
| 7,089,692 | B2 | 8/2006 | Strait | |
| 7,107,709 | B2 | 9/2006 | Hamel | |
| 7,658,022 | B2 | 2/2010 | Strait | |
| 8,776,405 | B2 | 7/2014 | Paonessa | |
| 8,875,419 | B2 * | 11/2014 | Schmeichel | 37/231 |
| 2013/0025629 | A1 | 1/2013 | Vigneault | |

FOREIGN PATENT DOCUMENTS

| | | |
|---|---|---|
| CA | 2610121 | 5/2009 |
| CA | 2611536 | 6/2009 |
| CA | 2796157 A1 | 10/2011 |
| CA | 2713260 | 2/2012 |
| CA | 2750723 | 2/2012 |
| CH | 382207 | 9/1964 |
| DE | 1299675 | 7/1969 |
| EP | 1557494 | 7/2007 |
| GB | 886572 | 1/1962 |

OTHER PUBLICATIONS

Installation of Heavy Duty Bucket Mounts, Arctic Incorporated.
Sectional Sno-Plow Heavy Duty Parts Manual, Arctic Incorporated, http://www.sectionplow.com/; last accessed on XX.
Installation of Light Duty Bucket Mounts, Arctic Incorporated.
Sectional Sno-Plow, The Only Plow You'll Ever Need, Arctic Incorporated.

* cited by examiner

SNOW PLOW FOR ADJUSTING TO SURFACE CONTOURS AND OBSTACLES

CROSS-REFERENCE TO RELATED APPLICATIONS

This application is a Divisional of U.S. application Ser. No. 13/136,340, filed on Jul. 29, 2011, entitled "SNOW PLOW FOR ADJUSTING TO SURFACE CONTOURS AND OBSTACLES," which is a continuation-in-part of U.S. patent application Ser. No. 13/180,158 filed on Jul. 11, 2011, which is a continuation-in-part of U.S. Pat. No. 7,975,409, issued on Jul. 12, 2011, which is a continuation of U.S. Pat. No. 7,555,853, issued on Jul. 7, 2009, the entirety of which is incorporated herein by reference.

FIELD OF INVENTION

This invention relates to a snow plow assembly and particularly relates to a snow plow having a structure for adjusting to surface contours and obstacles.

BACKGROUND OF THE INVENTION

Snow plows typically include, in addition to the moldboard, a pair of opposed generally planar wing plates fixed to opposed longitudinal ends of the moldboard. These wing plates cooperate with the moldboard in scooping snow during plowing operations. The structural stability of these wing plates, relative to the rest of the snow plow, is important because the wing plates are subject to significant stresses and could be bent or sheared away from the snow plow if not properly reinforced.

It is not uncommon for a snow plow to strike obstacles during snow clearing operations, such as frozen debris or objects buried beneath the snow such as road curbs and manhole covers. One approach to dealing with this problem is described in U.S. Pat. No. 2,962,821 to Pietl, which teaches a snow plow having individual blade sections that are oriented at a steep angle to the surface being plowed. The blade sections are slidingly received within guide pockets on the moldboard and are biased forwardly by springs, so that the blades can retract into the pockets when striking an obstacle. More typically, snow plow blades are mounted to snow plow bodies with a resilient trip mechanism that allows a snow plow blade to yield by generally pivoting upwardly and rearwardly upon striking such obstacles and to be restored to an operative position after encountering an obstacle. U.S. Pat. No. 4,794,710 to Haring, U.S. Pat. No. 5,437,113 to Jones, U.S. Pat. No. 5,697,172 to Verseef, British Patent Specification No. 886,572, German Patent Specification No. 3205974 and European Patent No. 1,557,494 provide examples of such resilient trip mechanisms.

In addition to the problem of obstacles, unevenness of the surface to be plowed also presents a problem, since a localized elevation can cause the entire snow plow to be lifted up. This leaves lower parts of the surface adjacent the elevation with a layer of snow. Similarly, the snow within a localized depression may also not be removed because the blade is carried by the higher surface adjacent the depression. A number of solutions to this issue have been proposed.

U.S. Pat. No. 4,669,205 to Smathers teaches a snow plow having a segmented blade formed from a plurality of individual bits each carried by a vertical shank of triangular cross-section which is slidably mounted in a triangular retention means on the moldboard of the snow plow, with the bits biased downwardly. The bits can be individually displaced upon encountering a higher point in the surface being plowed or an obstacle. According to this patent, "[t]he shanks to which the bits are attached must have a triangular cross-section" because "this is the only configuration which works satisfactorily".

U.S. Pat. No. 5,743,032 teaches a snow plow in which individual blades are attached to the moldboard by flexible members which permit the individual blades to move in one direction in response to obstacles or depressions in the surface being plowed.

U.S. Pat. No. 5,819,443 teaches a snow plow comprising a frame and a plurality of finger members each comprising a plowing portion and a curved flexing portion to enable the plowing portion to remain in contact with an uneven surface.

U.S. Pat. No. 6,823,615 to Strait describes a sectional snow plow made up of several individual sections, each mounted to a frame by flexible, resilient members so as to be independently movable. The sections can each move upwardly and downwardly relative to adjacent sections of the snowplow in response to variations in the surface below that section without causing the adjacent sections to be lifted above their respective surfaces. In the commercial embodiment offered by Arctic Snow and Ice Control, each section includes a resilient trip mechanism that allows the snow plow blade to yield by generally pivoting upwardly and rearwardly. The entire plowing face is formed by the individual moldboard sections, without any single moldboard extending the entire length of the plow, and the wing plates are pivotally mounted to the snow plow frame to provide a leveling function.

It remains a challenge in snow plow design to provide a snow plow that can effectively accommodate uneven surfaces as well as obstacles. It is a particular challenge to provide such a snow plow with a wing plate structure with adequate stability. It is also desirable to provide for leveling of the snow plow, and to provide an adjustable vehicle mounting assembly for a snow plow.

SUMMARY OF THE INVENTION

The present invention provides a snow plow having a moldboard and individual sections carried by the moldboard that can move vertically to accommodate uneven surfaces, with the individual sections each having a resilient trip mechanism that allows a snow plow blade to pivot upwardly and rearwardly upon striking an obstacle. One advantage of this design is that the moldboard provides a fixed attachment point for wing plates and for bracing struts to reinforce the wing plates.

In one aspect, the present invention is directed to a snow plow. The snow plow comprises a main plow body comprising a moldboard, and a plurality of surface-engaging sections movably carried by the moldboard and depending from the moldboard in side-by-side relationship with one another. Each of the surface-engaging sections is linearly movable relative to the moldboard between an extended position and a retracted position, independently of each other surface-engaging section, to adjust to the contour of the surface being plowed. Each of the surface-engaging sections comprises a main body portion carried by the moldboard, a surface-engaging trip blade portion pivotally carried by the main body portion so as to be pivotable between a surface-scraping position and a deflected position, and at least one biasing member acting between the main body portion and the trip blade portion to urge the trip blade portion toward the surface-scraping position.

Preferably, the snow plow further comprises at least one biasing member acting between the moldboard and each of the surface engaging-sections to urge the surface-engaging sections toward the extended position.

Also preferably, the main plow body further comprises a pair of opposed wing plates fixed to opposed longitudinal ends of the moldboard to cooperate with the moldboard for scooping snow, and the snow plow further comprises at least one bracing strut extending between the moldboard and each wing plate.

In one embodiment of the snow plow, for each surface-engaging section a first set of longitudinally spaced hinge portions is coupled to the main body portion, with each hinge portion in the first set of hinge portions having a respective rod aperture, and a second set of longitudinally spaced hinge portions is coupled to the surface-engaging trip blade portion, with each hinge portion in the second set of hinge portions having a respective rod aperture. A longitudinally extending pivot rod is received through the rod apertures of the first and second sets of longitudinally spaced hinge portions thereby coupling the main body portion to the surface-engaging trip blade portion. The at least one biasing member comprises a coil spring disposed between the first set of longitudinally spaced hinge portions and the second set of longitudinally spaced hinge portions on the at least one longitudinally extending pivot rod, to urge the surface-engaging trip blade portion toward the surface-scraping position. The first set of longitudinally spaced hinge portions includes a hinge portion having a receiving slot to slidingly receive a hinge key, and a hinge key is received in the receiving slot. The hinge key defines a bearing surface for abutting one end of the coil spring, and has a locating notch to limit relative movement between the hinge key and the hinge portion having the receiving slot. In one embodiment, the hinge key is substantially T-shaped. A locating notch of the hinge key may be disposed on a side opposite from the bearing surface for abutting the coil spring.

In another aspect, the present invention is directed to a snow plow comprising a main plow body which comprises a moldboard and a pair of opposed wing plates fixed to opposed longitudinal ends of the moldboard to cooperate with the moldboard for scooping snow. The snow plow further comprises a pair of a wear shoes for supporting the main plow body on the surface being plowed with a surface-engaging edge of the snow plow in engagement with the surface. Each wear shoe is carried by and supports one of the wing plates, and is pivotally mounted to the respective wing plate proximally to the moldboard so that the main plow body can pivot relative to the wear shoes when the wear shoes rest on a surface.

In a preferred embodiment, the range of pivotal movement of the main plow body relative to the wear shoes is limited by at least one stop acting between the wear shoes and the main plow body. In one particular implementation, for each wear shoe and wing plate set, one of the wear shoe and the wing plate has a closed arcuate slot defined therein and located distally from the moldboard, and the stop comprises a rod projecting from the other of the wear shoe and the wing plate through the arcuate slot.

In a further aspect, the present invention is directed to a snow plow having an adjustable vehicle mounting assembly. The snow plow comprises a main plow body comprising a moldboard having a plowing face and a pushing face opposed to the plowing face. The adjustable vehicle mounting assembly comprises two support frames carried by the pushing face of the moldboard, with the support frames being longitudinally spaced from one another. At least one guide shaft is carried by each support frame. The snow plow further comprises two vehicle receivers securable to a plowing vehicle, with each vehicle receiver being slidably received on a corresponding at least one guide shaft for non-rotating, parallel linear movement along the respective guide shafts toward and away from a surface-engaging edge of the snow plow within a limited range of motion.

In one embodiment, each support frame carries a single guide shaft of polygonal cross-section and the vehicle receiver includes a corresponding sleeve in which the guide shaft is received.

In another embodiment, each support frame carries at least two spaced-apart guide shafts and the vehicle receiver includes at least one guide bar having corresponding spaced-apart guide apertures in which the guide shafts are received.

BRIEF DESCRIPTION OF THE DRAWINGS

In order that the invention can be more clearly understood, a preferred embodiment is described below with reference to the accompanying drawings, in which.

DETAILED DESCRIPTION

Figure 1:
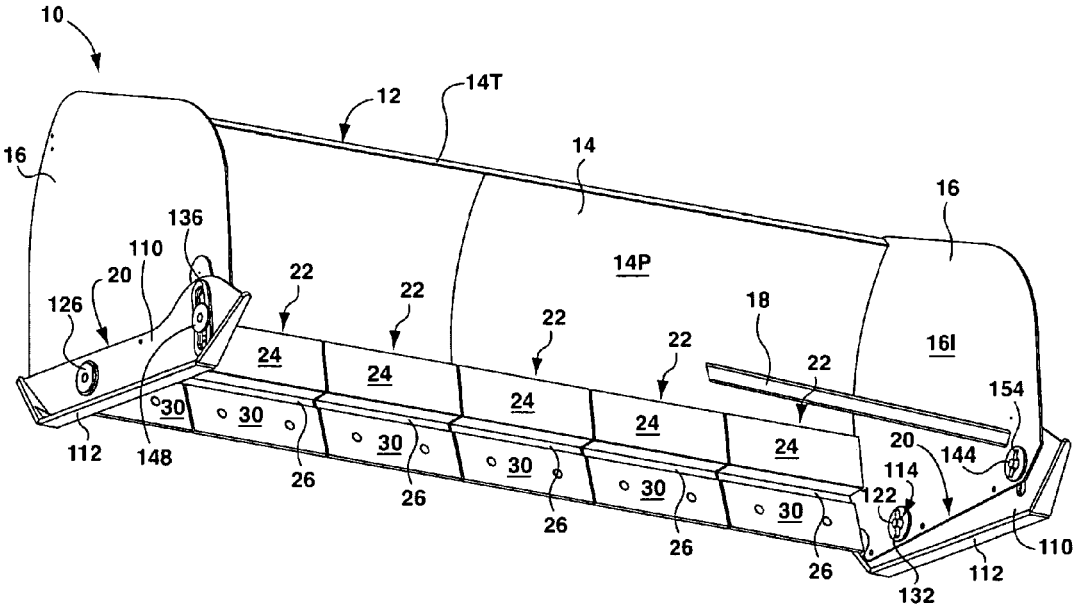
FIG. 1 is an isometric front view of a first exemplary embodiment of a snow plow according to an aspect of the present invention showing the surface-engaging sections thereof in a retracted position.

Reference is now made to FIGS. 1 to 4, in which a first embodiment of an exemplary snow plow according to an aspect of the present invention is shown generally at 10. The snow plow 10 comprises a main plow body 12 formed by a curved moldboard 14 having a plowing face 14P and a pair of opposed generally planar wing plates 16 fixed to opposed longitudinal ends of the moldboard 12. In operation, the wing plates 16 cooperate with the moldboard 14 for scooping snow. The moldboard 14 is somewhat curved forwardly and is reinforced with vertically extending reinforcement ribs 14R, and includes a reinforced push channel 14C on the lower portion of the moldboard 14, relative to the surface to be plowed. A reinforced top edge 14T of the moldboard 14 is fitted with a pair of longitudinally spaced handles 14H for lifting the snow plow 10 by means of a crane or the like in order to load and off load the snow plow 10 on delivery of same. However, during day to day use, the snow plow 10 is moved by means of a vehicle which pushes the plow body forwardly by engaging a pair of rearwardly extending vehicle receivers 62. For example, the snow plow 10 might be pushed by a front end loader. Mounting of the vehicle receivers 62 is described in greater detail below. Bracing struts 18 (FIG. 1) extend between the moldboard 14 and each wing plate 16, in particular between the plowing face 14P of the moldboard 14 and the inside faces 161 of the wing plates 16. The exemplary snow plow 10 also includes a pair of a wear shoes 20 for supporting the main plow body 12 on the surface being plowed, with each wear shoe 20 being carried by and supporting one of the wing plates 16. Mounting of the wear shoes 20 to the wing plates 16 is described in greater detail below.

Figure 2:
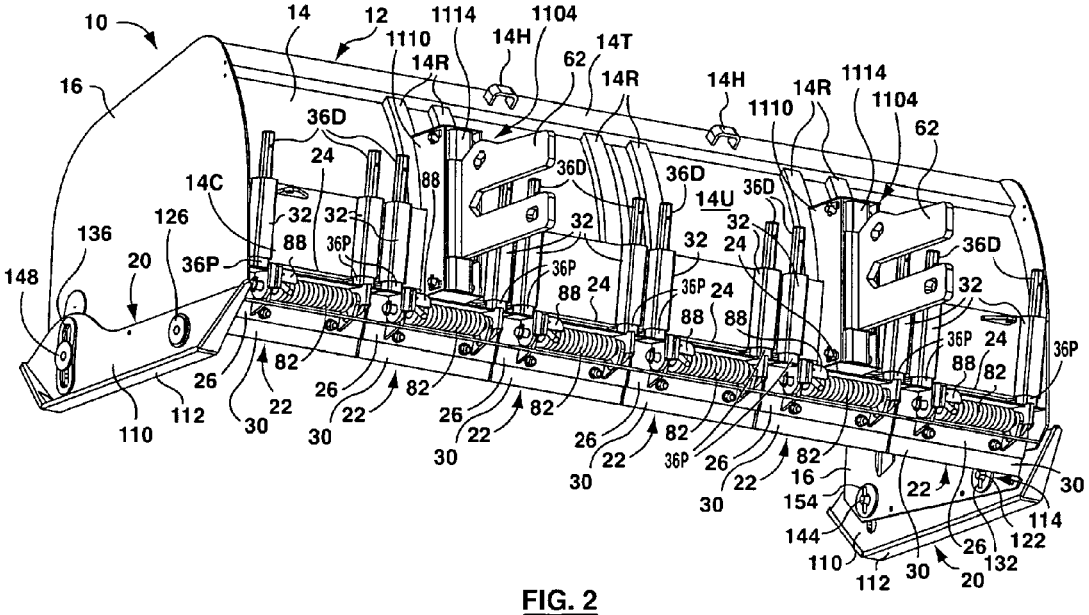
FIG. 2 is an isometric rear view of the snow plow of FIG. 1 showing the surface-engaging sections thereof in a retracted position.
Figure 3:
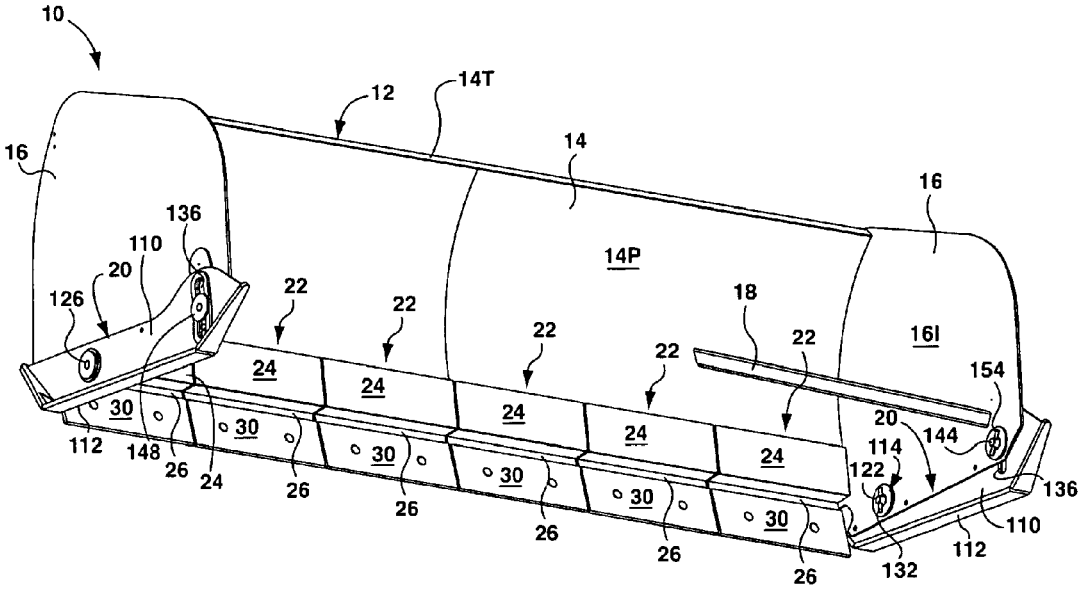
FIG. 3 is an isometric front view of the snow plow of FIG. 1 showing the surface-engaging sections thereof in an extended position.
Figure 4:
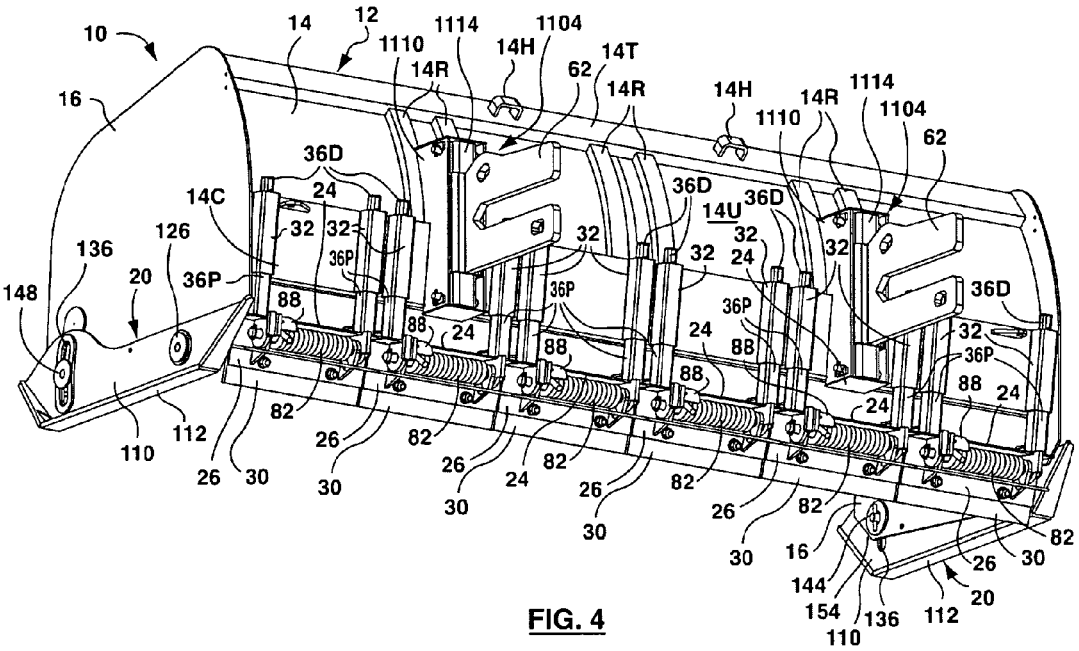
FIG. 4 is an isometric rear view of the snow plow of FIG. 1 showing the surface-engaging sections thereof in an extended position.

The snow plow 10 comprises a plurality of surface-engaging sections 22 movably carried by the moldboard 14 and depending from the moldboard 14 in side-by-side relationship with one another. Each of the surface-engaging sections 22 is carried by the moldboard 14 so as to be linearly movable relative to the moldboard 14, independently of each other surface-engaging section 22, between a retracted position, as shown in FIGS. 1 and 2, and an extended position, as shown in FIGS. 3 and 4. The ability of the surface-engaging sections 22 to move linearly relative to the moldboard 14 enables the snow plow 10 to adjust to a contour of a surface being plowed.

Figure 5:
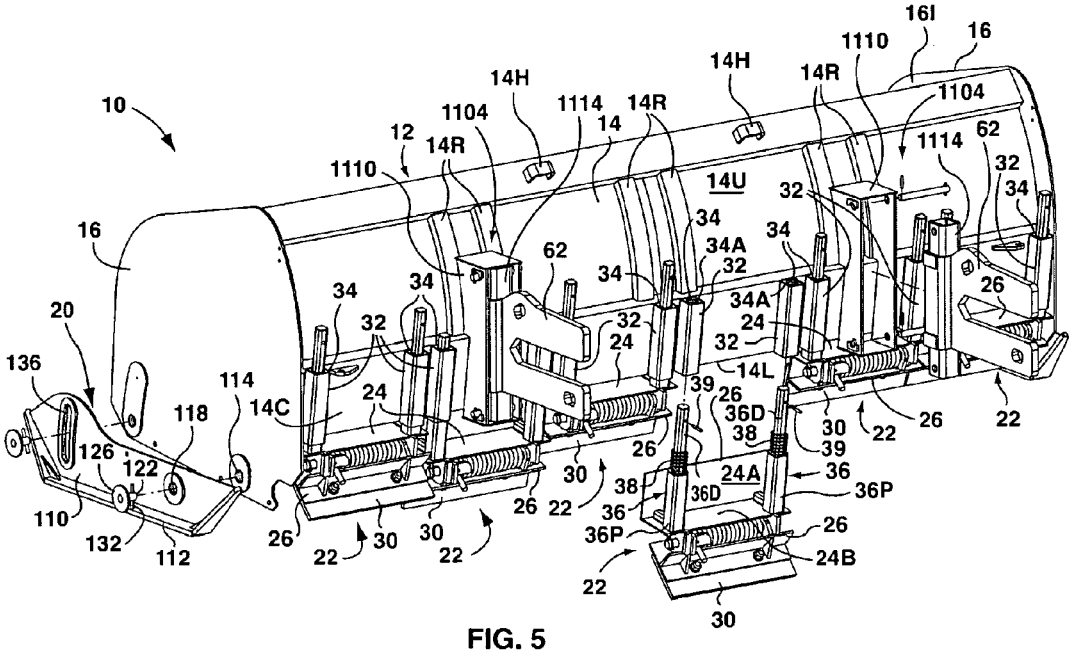
FIG. 5 is a partially exploded isometric rear view of the snow plow of FIG. 1.

As best seen in FIGS. 5 and 6, each of the surface-engaging sections 22 comprises a main body portion 24 carried by the moldboard 14, a surface-engaging trip blade portion 26 pivotally carried by the main body portion 24 so as to be pivotable between a surface-scraping position and a deflected position, and a biasing member in the form of a coil spring 82 acting between the main body portion 24 and the trip blade portion 26 to urge the trip blade portion 26 toward the surface-scraping position. The trip blade portion 26 carries a replaceable blade 30 for scraping snow. The blades 30 will typically be formed of heat treated steel in order to make them more resistant to the constant wear arising from scraping a road surface or the like.

The independently movable surface-engaging sections 22, including the trip blade portions 26, enable the snow plow 10 to accommodate uneven surfaces and obstacles by adjusting to the surface to be plowed. In FIG. 5, the leftmost surface-engaging section 22 is shown in the retracted position with its trip blade portion 26 in the deflected position, the second surface-engaging section 22 from the left is shown in the extended position with its trip blade portion 26 in the surface-scraping position, and the third surface-engaging section 22 from the left is shown in the retracted position with its trip blade portion 26 in the surface-scraping position. The fourth surface-engaging section 22 from the left (third from the right) is shown disengaged from the moldboard 14 to illustrate the linearly movable mounting of the surface-engaging section 22 to the moldboard 14. The two rightmost surface-engaging sections 22 are shown in the retracted position with their trip blade portions 26 in the surface-scraping position.

In the exemplary embodiment each of the surface-engaging sections 22 is slidably mounted to the moldboard 14 by way of two parallel hollow tubes 32 carried on the pushing face 14U of the moldboard 14 at or adjacent the lower edge 14L thereof. Specifically, the tubes 32 are mounted on the reinforced push channel 14C. As best seen in FIG. 6C, the tubes 32 each have an inwardly projecting flange 34 at their upper ends which defines an aperture 34A.

Figure 6A:
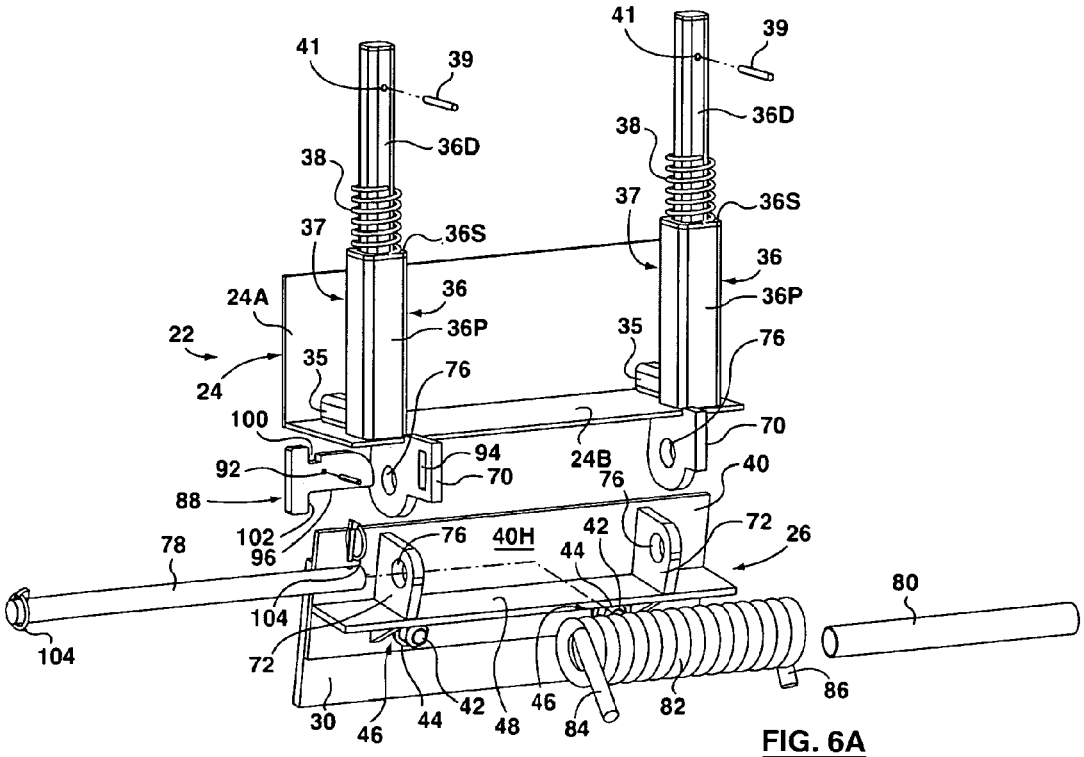
FIG. 6A is an exploded isometric rear view of one of the surface-engaging sections of the snow plow of FIG. 1.
Figure 6B:
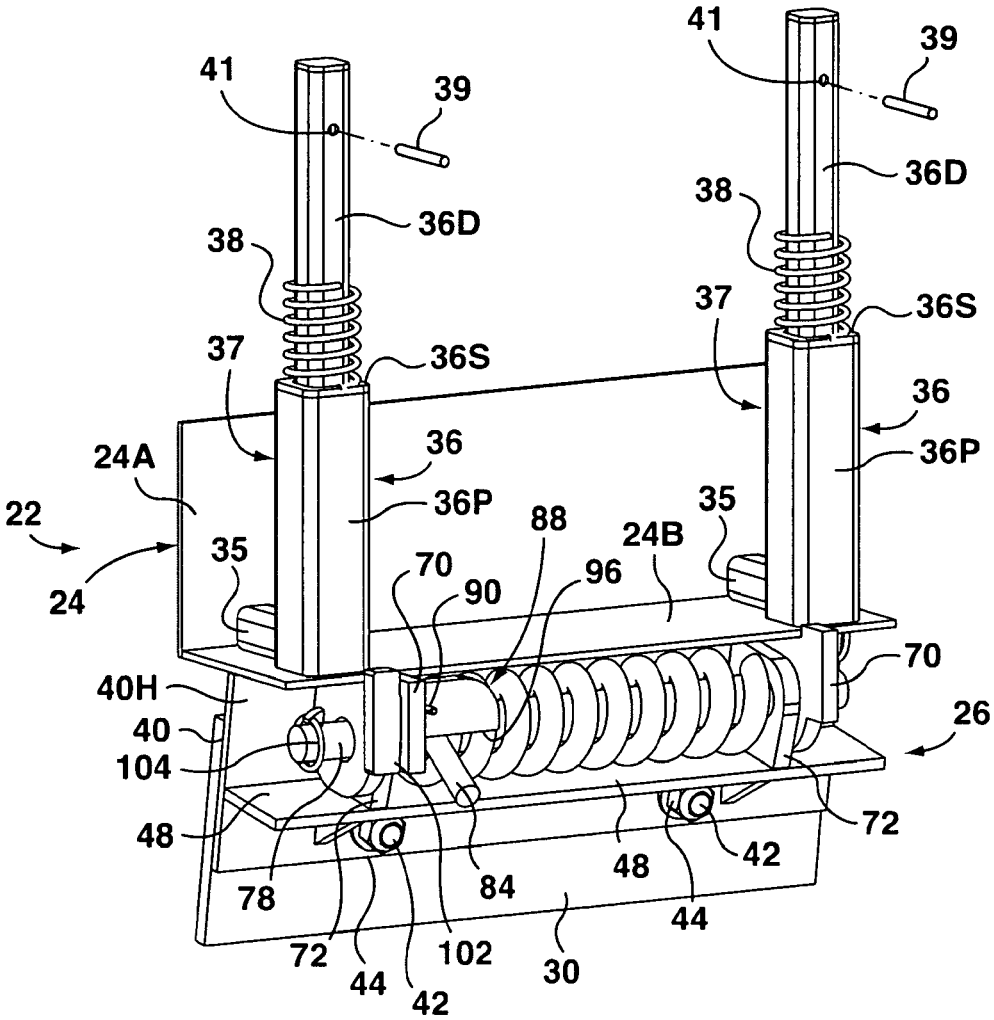
FIG. 6B is an assembled isometric rear view of one of the surface-engaging sections of FIG. 6A.
Figure 6C:
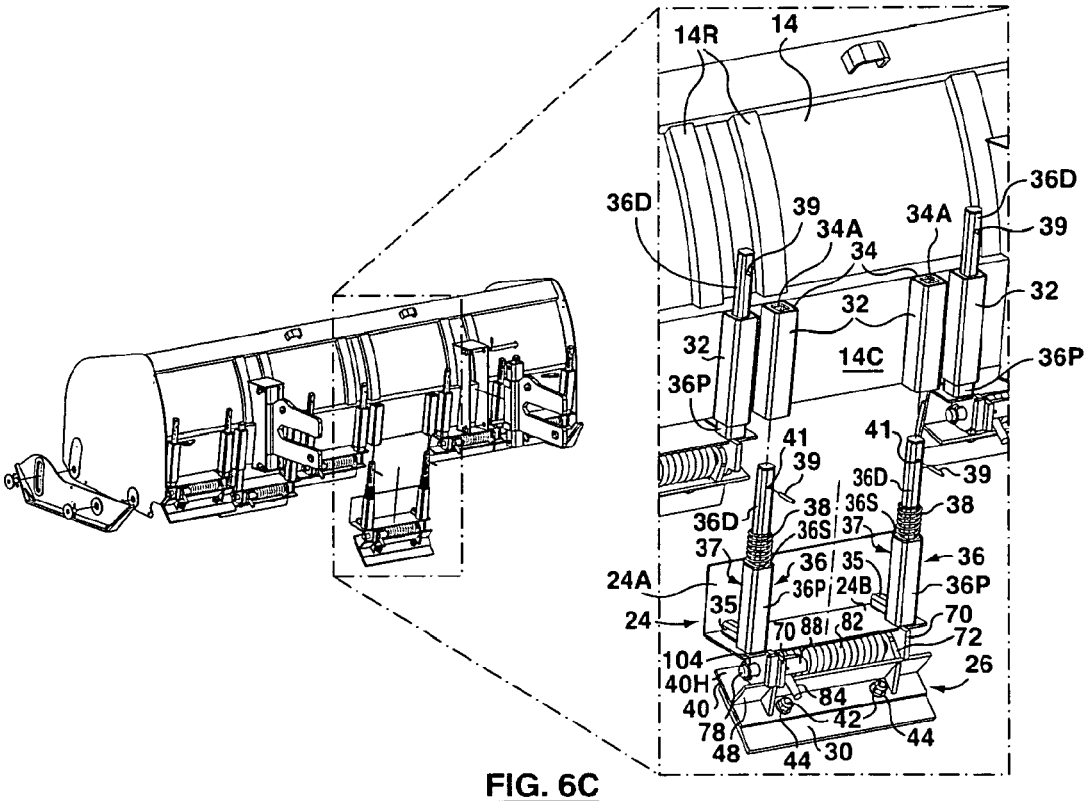
FIG. 6C is a detailed partially exploded isometric rear view showing mounting of the surface-engaging section of FIG. 6A on the main plow body of the snow plow of FIG. 1.

Referring now to FIGS. 6A to 6C, the main body portion 24 of each surface-engaging section 22 comprises a spacer 24B as well as a generally planar snow-engaging panel 24A and two spaced-apart square mounting shafts 36. The snow-engaging panel 24A and the mounting shafts 36 extend from the same side of the spacer 24B generally parallel to one another and, when the surface-engaging section 22 is mounted to the moldboard 14 with the snow plow 10 resting on a surface, will project generally upwardly at a slight incline from vertical. The snow-engaging panel 24A and the mounting shafts 36 are spaced from one another by the spacer 24B to define a gap 37 between the snow-engaging panel 24A and each mounting shaft 36. Braces 35 extend between the snow-engaging panel 24A and each mounting shaft 36, adjacent the spacer 24B, to reinforce the mounting shafts 36. When the surface-engaging section 22 is mounted to the moldboard 14, the lower edge 14L of the moldboard 14 is received in the gap 37 between the snow-engaging panel 24A and the mounting shafts 36.

The mounting shafts 36 each comprise a proximal portion 36P and a distal portion 36D, in each case relative to the spacer 24B. The proximal portion 36P of each mounting shaft 36 is larger in cross-section than the distal portion 36D thereof so as to define a shoulder 36S between the proximal portion 36P and the distal portion 36D. The shoulder 36S acts as a first bearing surface for a biasing member in the form of a coil spring 38 which surrounds the part of the distal portion 36D adjacent the proximal portion 36P. The proximal portion 36P of each mounting shaft 36 is sized to be slidingly received within one of the hollow tubes 32 carried on the pushing face 14U of the moldboard 14, with the smaller distal portion 36D extending through and beyond the aperture 34A defined by the inwardly projecting flange 34 on the hollow tube 32. The flange 34 is sized to act as a second bearing surface for the coil spring 38. When the mounting shaft 36 is slidingly received within a corresponding hollow tube 32, the coil spring 38 is captured between the first bearing surface defined by the shoulder 36S on the mounting shaft 36 and the second bearing surface defined by the inwardly projecting flange 34 on the hollow tube 32. The coil spring 38 thus acts between the moldboard 14 and the surface engaging-section 22 to urge the surface-engaging section 22 toward the extended position. A locking pin 39 is received in a corresponding aperture 41 adjacent the distal end of the mounting shaft 36 to define the extended position of the surface-engaging section 22. Specifically, the locking pin 39 acts as a stop by bearing against the inwardly projecting flange 34 on the hollow tube 32 to prevent the mounting shaft 36 from sliding out of the hollow tube 32 once installed.

Continuing to refer to FIGS. 6A to 6C, the trip blade portion 26 of each surface-engaging section 22 comprises a mounting bracket 40 which removably receives a replaceable blade 30, and a hinge bearing panel 48 extending substantially perpendicularly from the surface 40H of the mounting bracket 40 opposite the surface of the mounting bracket 40 that receives the blade 30. The blade 30 is mounted to the mounting bracket 40 by way of bolts 42 which are secured by nuts 44 and extend through apertures 46 in the mounting bracket 40 and the blade 30.

A first pair of longitudinally spaced hinge portions 70 depend from the side of the spacer 24B opposite the side from which the snow-engaging panel 24A and the mounting shafts 36 extend, and a second pair of longitudinally spaced hinge portions 72 is secured to the mounting bracket 40 extends between the hinge bearing panel 48 and the surface 40H of the mounting bracket 40 opposite the surface of the mounting bracket 40 that receives the blade 30. Each of the hinge portions 70, 72 has a respective rod aperture 76 which slidingly receives a longitudinally extending pivot rod 78.

The rod 78 is preferably covered by a cylindrical sleeve 80 that extends between the hinge portions 70, 72 and which is in turn surrounded by a coil spring 82. The cylindrical sleeve 80 thereby operates as a bushing to prevent the coil spring 82 from binding on the pivot rod 78. The coil spring 82 serves as a biasing member disposed between the first series of longitudinally spaced hinge portions 70 and the second series of longitudinally spaced hinge portions 72 in order to urge the trip blade portion 26 toward the surface-scraping position and to resiliently restore the trip blade portion 26 toward the surface-scraping position from the deflected position after encountering an obstacle.

Figure 7:
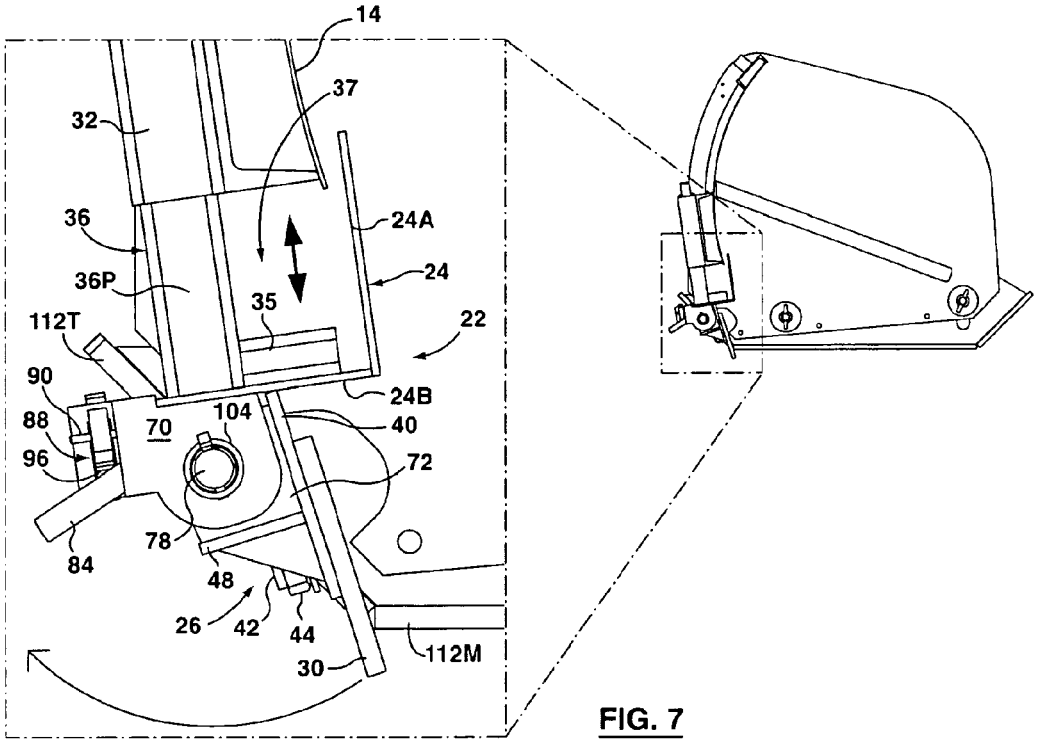
FIG. 7 is a side cut-away detail view of a portion of the snow plow of FIG. 1 showing one of the surface-engaging sections of FIG. 6A.

Now referring additionally to FIG. 7 as well as FIGS. 6A to 6C, each coil spring 82 has first and second ends 84, 86 of which the first end 84 bears against one of the hinge portions 70 on the spacer 24B via a hinge key 88 and of which the second end 86 bears against the hinge bearing panel 48 on the mounting bracket 40.

In proximity to the rod aperture 76, one of the first hinge portions 70 has a receiving slot 94 which is formed to extend vertically when the surface-engaging section 22 is upright and to slidingly receive the aforementioned hinge key 88. Only one of the hinge portions 70 requires a hinge key for coupling to the first end 84 of the coil spring 82, as the other hinge portion 70 is disposed adjacent the second free end 86 of the coil spring 82 which bears upon the hinge bearing panel 48 on the mounting bracket 40.

The hinge key 88 is inserted into the receiving slot 94 to come to a rest position where a bearing surface 96 abuts the first end 84 of the coil spring 82. Opposite from the bearing surface 96, a notch 100 is formed in the hinge key 88 so that opposing shoulders of the notch 100 are disposed on opposite sides of the first hinge portion 70 to limit relative movement between the hinge key 88 and the hinge portion 70. For added security, and to prevent accidental release of the spring coil 82 from the preloaded condition shown in the drawings, the hinge key 88 includes a second shoulder 102 formed on the same side as the bearing surface 96 and opposite from the notch 100 thereby forming the top portion of a "T" shaped hinge key 88. In addition, a pin 90 is friction fit into an aperture 92 in the hinge key 88 so that when the surface-engaging section 22 is assembled, the hinge portion 70 is trapped between the pin 90 and the second shoulder 102 on the hinge key 88.

The main body portion 24 and the trip blade portion 26 are mounted to one another to form the surface-engaging section 22 as follows. The pivot rod 78 is inserted between first and second hinge portions 70 and 72 and the sleeve 80 and coil spring 82 are slid over the pivot rod 78. A specialized tool (not shown) is used to pre-stress the coil springs 82 thereby allowing sufficient clearance to insert the hinge key 88 in the receiving slot 94 so as to abut the free end 84 of the coil spring 82. After the assembly is completed, a locating ring 104 is positioned in receiving apertures formed at each end of the pivot rod 78 so as to secure the assembly. It will be understood that the receiving slot 94 has a sufficient length to accommodate both the width of the hinge key 88 and an additional clearance sufficient to pre-load the coil spring 82 to a desired value.

Figure 10A:
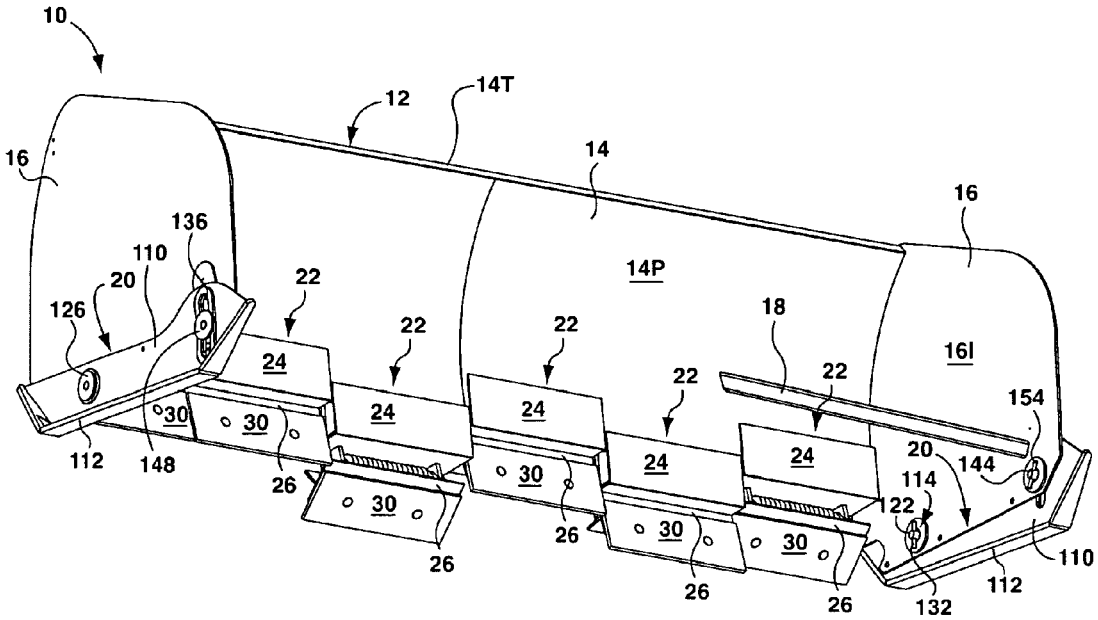
FIG. 10A is an isometric front view of the snow plow of FIG. 1 showing various positions of the surface-engaging sections and the trip-blade portions of the surface-engaging sections.
Figure 10B:
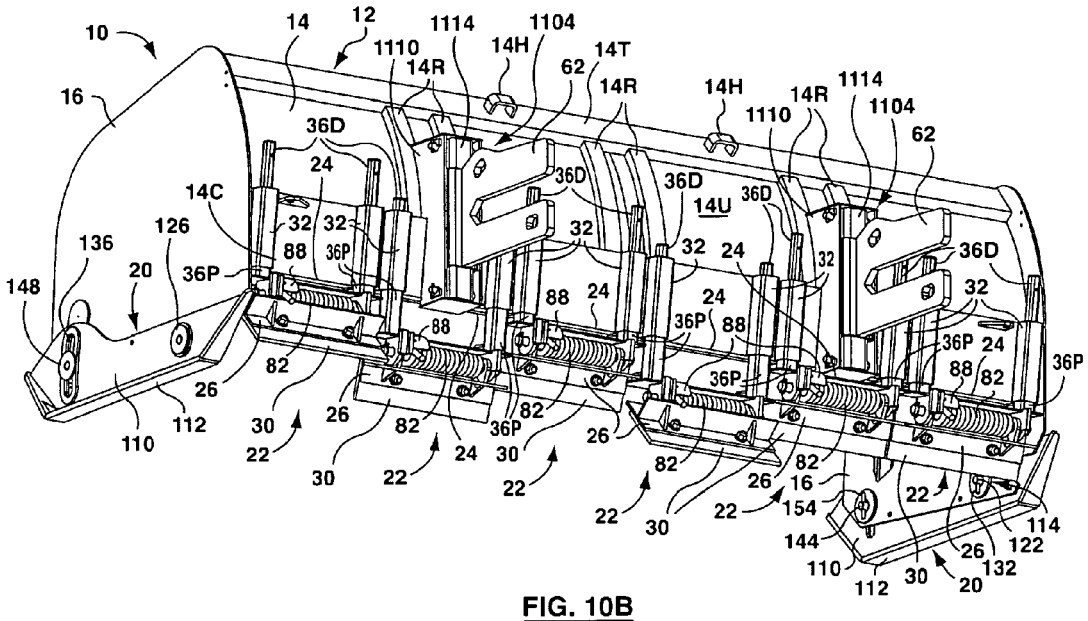
FIG. 10B is an isometric rear view of the snow plow of FIG. 1 showing various positions of the surface-engaging sections and the trip-blade portions of the surface-engaging sections.
Figure 11A:
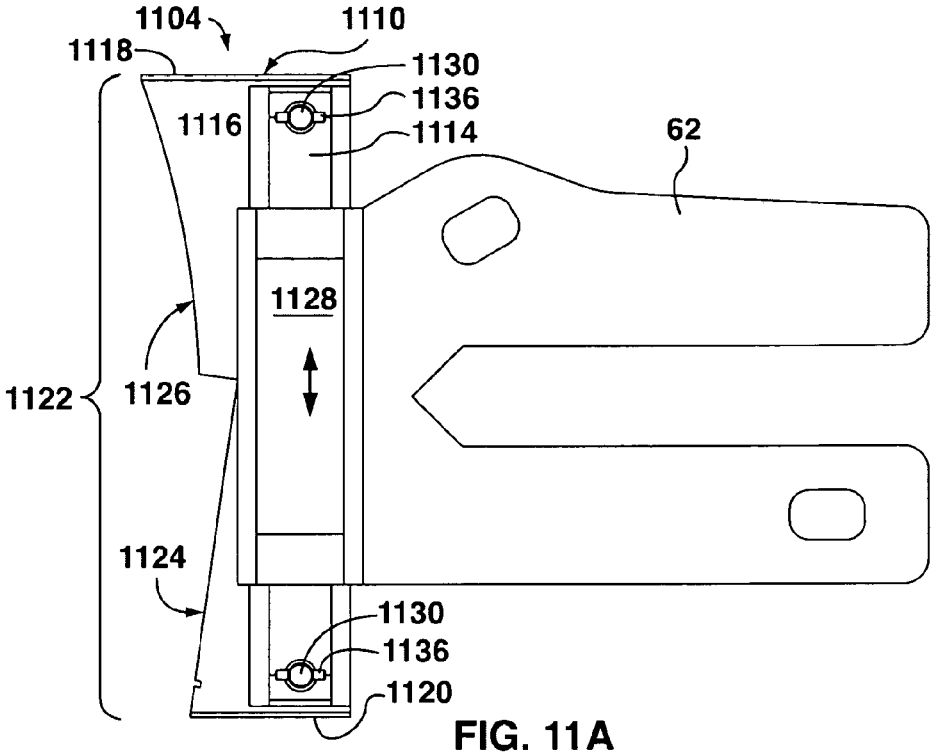
FIG. 11A is a side cut-away view of a vehicle mount of the snow plow of FIG. 1.
Figure 11B:
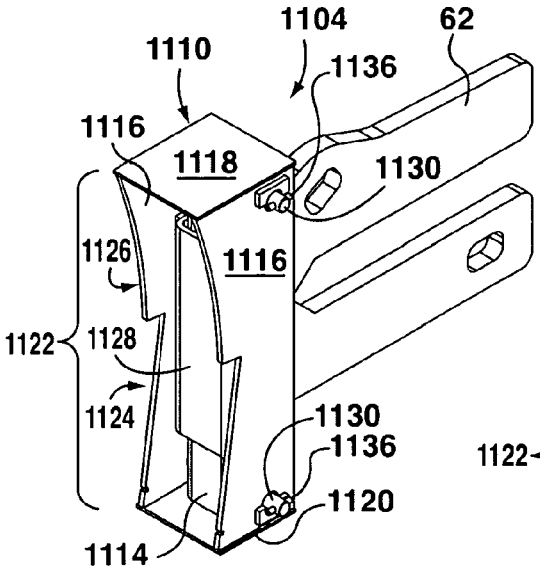
FIG. 11B is an isometric front view of the vehicle mount of FIG. 11A.
Figure 11C:
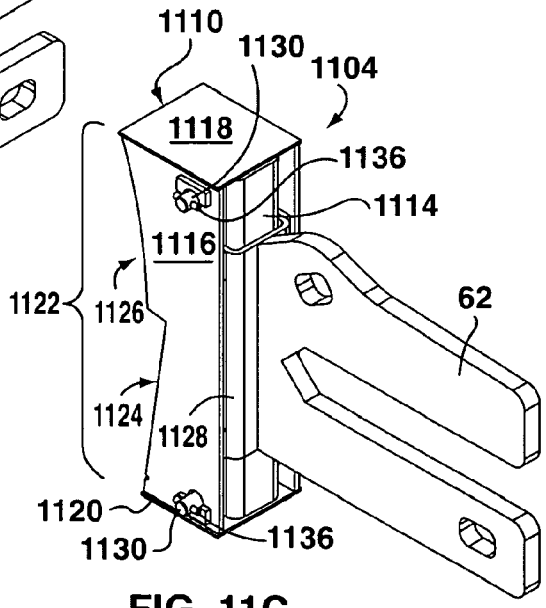
FIG. 11C is an isometric rear view of the vehicle mount of FIG. 11A.

FIGS. 10A and 10B show various configurations of the surface-engaging sections 22 and trip blade portions 26. In FIG. 10A, the two leftmost surface-engaging sections 22 (the two rightmost surface-engaging sections in FIG. 10B) are shown in the retracted position with their trip blade portions 26 in the surface-scraping position, and the third surface-engaging section 22 from the left (third from the right in FIG. 10B) is shown in the extended position with its trip blade portion 26 in the deflected position. Continuing to refer to FIG. 10A, the third surface-engaging section 22 from the right (third from the left in FIG. 10B) is shown in the retracted position with its trip blade portion 26 in the surface-scraping position, the second surface-engaging section 22 from the right (second from the left in FIG. 10B) is shown in the extended position with its trip blade portion 26 in the surface-scraping position, and the rightmost surface-engaging section 22 (leftmost in FIG. 10B) is shown in the retracted position with its trip blade portion 26 in the deflected position.

The ability of the surface-engaging sections 22 to move independently, relative to the moldboard 14, between the extended position and the retracted position allows the snow plow 10 to adjust to the contour of the surface being plowed. One or more individual surface-engaging sections 22 can rise to accommodate a local rise in the surface, or descend into a local depression in the surface, with the respective blades 30 remaining engaged with the surface and without lifting or lowering the rest of the snowplow. In addition, the trip blade portions 26 with the blades 30 can deflect to accommodate obstacles, and can cooperate with the linear movement of the surface-engaging sections 22 to accommodate larger obstacles than can be accommodated solely by deflection of the trip blade portions 26 and blades 30.

As noted above, the exemplary snow plow 10 also includes a pair of wear shoes 20 for supporting the main plow body 12 on the surface being plowed. The wear shoes 20 support the main plow body 12 such that the blades 30 carried by the surface-engaging trip blade portions 26 are in engagement with the surface to be plowed. As explained in greater detail below, each wear shoe 20 is pivotally mounted to a respective wing plate 16 proximally to the moldboard 14 so that the main plow body 12 can pivot relative to the wear shoes 20 when the wear shoes 20 rest on a surface.

Figure 8:
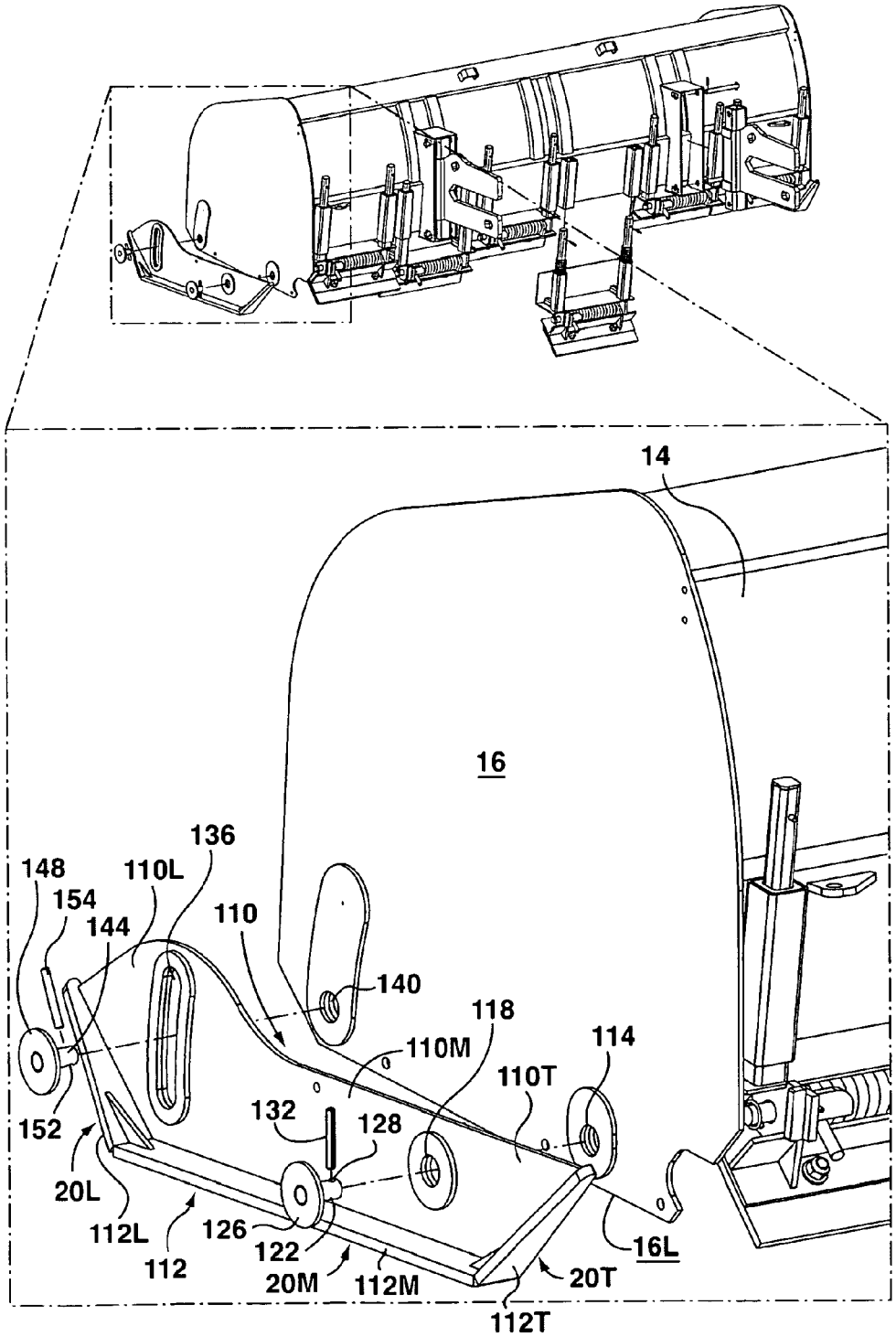
FIG. 8 is a detailed partially exploded isometric rear view showing mounting of one of the wear shoes on the wing plate of the snow plow of FIG. 1.

Referring now to FIG. 8, each wear shoe 20 is carried by and supports one of the wing plates 16, and comprises an ankle plate 110 which articulates relative to the wing plate 16 and a skid plate 112 mounted to the ankle plate 110, with the ankle plate 110 being generally perpendicular to the skid plate 112. Each wear shoe defines a main portion 20M, a leading portion 20L and a trailing portion 20T, and the ankle plate 110 and skid plate 112 include corresponding main portions 110M, 112M, leading portions 110L,112L and trailing portions 110T, 112T. During operation of the snow plow 10, the main portion 20M of the wear shoe 20, and in particular the main portion 112M of the skid plate 112, will slide along the surface being plowed. The leading portion 110L of the ankle plate 110 is shaped so that the leading portion 112L of the skid plate 112 slopes upwardly from the main portion 112M of the skid plate 112, and similarly the trailing portion 110T of the ankle plate 110 is shaped so that the trailing portion 112T of the skid plate 112 slopes upwardly from the main portion 112M of the skid plate 112. The overall shape of the wear shoe 20 assists in accommodating unevenness in a surface being plowed and allows the wear shoe 20 to slide over small obstacles.

Continuing to refer to FIG. 8, each wear shoe 20 is pivotally mounted to the outside of the respective wing plate 16, proximally to the moldboard 14, so that the main plow body 12, including the wing plates 16, can pivot relative to the wear shoes 20 when the wear shoes 20 rest on a surface. In the illustrated embodiment, each wing plate 16 includes a reinforced aperture 114 therethrough toward its lower edge 16L, proximally to the moldboard 14, and each wear shoe 20 has a corresponding reinforced aperture 118 defined through the main portion 110M of the ankle plate 110, adjacent the trailing portion 20T of the wear shoe 20. A pivot rod 122 having an outer flange 126 is inserted through the apertures 114, 118 and secured by friction-fitting a locking pin 132 into an aperture 128 in the pivot rod 122, so that the ankle plate 110 and the wing plate 16 are trapped between the outer flange 126 and the locking pin 132 and can pivot relative to one another.

The range of pivotal movement of the main plow body 12, relative to the wear shoes 20, is limited by a stop that acts between each wear shoe 20 and the main plow body 12. In the illustrated embodiment, a reinforced closed arcuate slot 136 is defined in the main portion 110M of the ankle plate 110, adjacent the leading portion 20L of the wear shoe 20, and a reinforced aperture 140 is defined through the wing plate 16 toward the lower edge 16L thereof. A guide rod 144 having an outer flange 148 is inserted through the apertures 140 and the arcuate slot 136 and secured by friction-fitting a locking pin 154 into an aperture 152 in the guide rod 144, trapping the ankle plate 110 and the wing plate 16 between the outer flange 148 and the locking pin 154. Because the guide rod 144 projects from the wing plate 16 through the arcuate slot 136 in the wear shoe 20, when the wear shoe 20 and wing plate 16 pivot relative to one another about the pivot rod 122, the guide rod 144 slides within the arcuate slot 136 and acts as a stop by preventing the wear shoe 20 and wing plate 16 from pivoting beyond the limits defined by the arcuate slot 136. It will be appreciated that the positions of the aperture and arcuate slot may be reversed, with the aperture being in the wing plate and the arcuate slot being in the ankle plate.

Figure 9A:
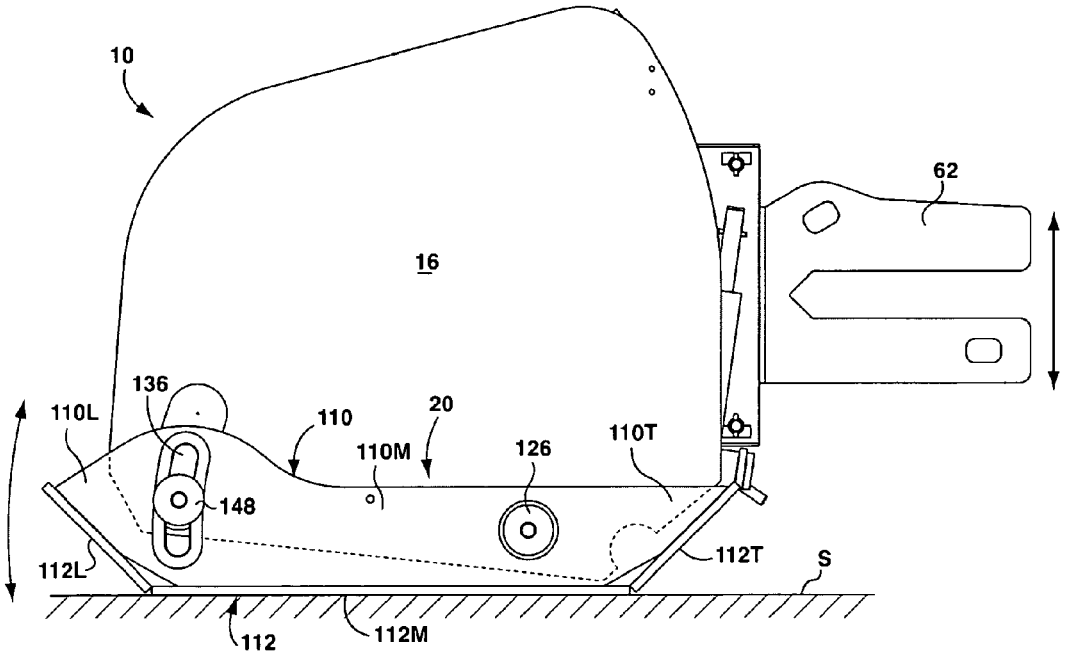
FIGS. 9A to 9C show pivoting of the wear shoes of FIG. 8 relative to the main plow body for various angles of the main plow body relative to the surface to be plowed.
Figure 9B:
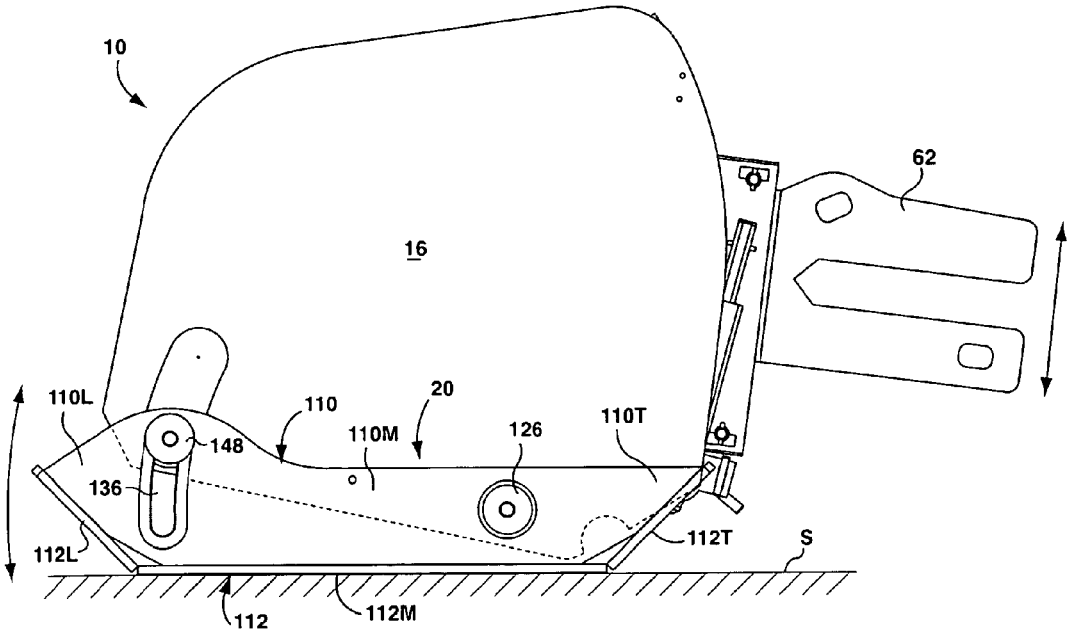
Figure 9C:
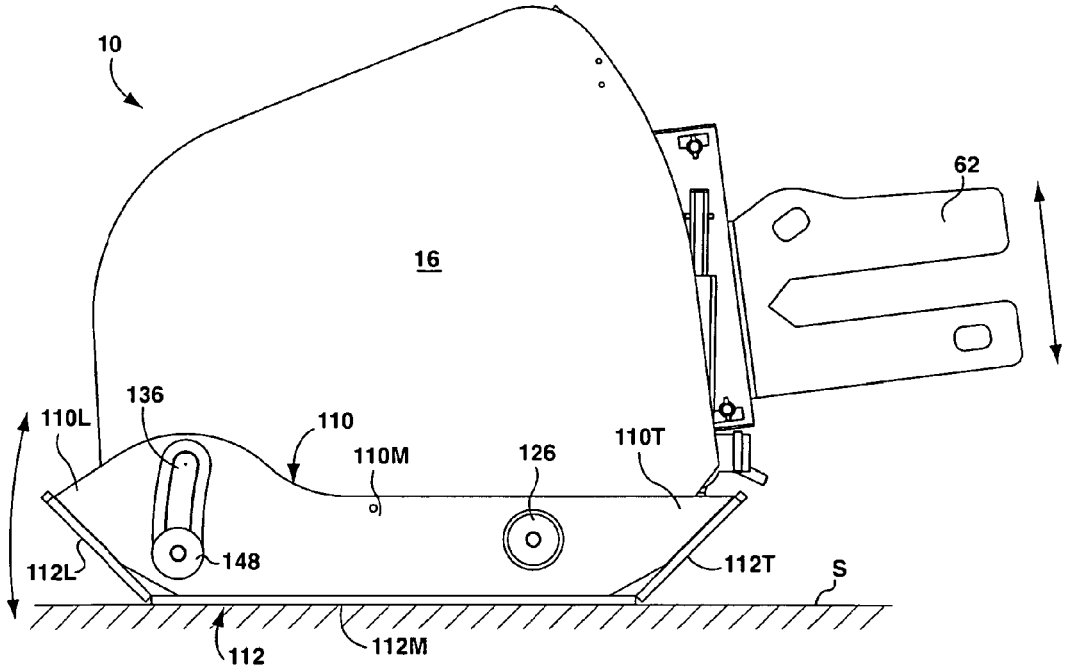

The ability of the main plow body 12 to pivot relative to the wear shoes 20 when the wear shoes 20 rest on a surface S provides the snow plow 10 with a self-leveling function. Instead of having to carefully adjust the position of the main plow body 12 to ensure proper engagement of the blades 30 with the surface being plowed, an operator need only lower the snow plow 10 approximately into position, and the wear shoes 20 will pivot relative to the main plow body 12 until the wear shoes 20, and in particular the main portions 112M of the skid plates 112, are generally level with the surface S being plowed. FIGS. 9A to 9C show how, for various angles of the main plow body 12 relative to the surface S to be plowed, the wear shoes 20 will pivot to be level with the surface S to be plowed. Moreover, because the individual surface-engaging sections 22 are biased toward the extended position, within the range of pivotal motion permitted by the arcuate slots 136 the blades 30 will always be pushed into engagement with the surface S being plowed.

Snow plows according to aspects of the present invention, such as the exemplary snow plow 10 described above, preferably include an adjustable vehicle mounting assembly. As shown in FIGS. 2, 4 and 5, in the exemplary snow plow 10 described above, the vehicle mounting assembly comprises a pair of vehicle mounts 1104 carried by the moldboard 14 on the pushing face 14U thereof, longitudinally spaced from one another along the length of the moldboard 14. Each vehicle mount 1104 comprises a support frame 1110 secured on the pushing face 14U of the moldboard, a guide shaft 1114 carried by the support frame 1110, and a vehicle receiver 62 securable to a plowing vehicle (not shown). The vehicle receivers 62 slide non-rotatably along their respective guide shafts 1114 so that the position of the vehicle receivers 62 relative to the moldboard 14 can be adjusted.

FIGS. 11A to 11C and 12A and 12B show construction of the components of the exemplary vehicle mounts 1104 shown in FIGS. 2, 4 and 5. As can be seen, each support frame 1110 comprises a pair of opposed, spaced-apart mounting plates 1116 and opposed top and bottom plates 1118, 1120. Each of the mounting plates 1116 has a contoured mounting edge 1122 comprising a push channel edge portion 1124 and an upper moldboard portion 1126. The push channel edge portion 1124 is shaped to match the contours of the reinforced push channel 14C on the lower portion of the moldboard 14 and the upper moldboard edge portion 1126 is shaped to match the contours of the upper portion of the moldboard 14 adjacent the push channel 14C, in each case on the pushing face 14U of the moldboard 14. The contoured mounting edges 1122 on the mounting plates 1116 assists in mounting the support frame 1110 on the pushing face 14U of the moldboard 14.

The guide shaft 1114 carried by the support frame 1110 has a square cross-sectional shape with rounded corners, and the vehicle receiver 62 includes a correspondingly shaped sleeve 1128 in which the guide shaft 1114 is received. The squared cross-sectional shape of the guide shaft 1114 and the sleeve 1128 limit the receiver 62 to linear motion along the guide shaft 1114 and inhibit the receiver 62 from rotating relative to the guide shaft 1114. Although the guide shaft 1114 is shown as square, any suitable polygonal shape may be used for the guide shaft 1114 and sleeve 1128, preferably with rounded corners to inhibit binding. When the vehicle mounts 1104 are secured to the snow plow 10 as shown in FIGS. 2, 4 and 5, the receivers 62 can ride along the respective guide shafts 1114 in parallel linear motion toward and away from the surface-engaging edge of the snow plow 10. This assists an operator in positioning the snow plow 10 on the surface to be plowed.

Figure 12A:
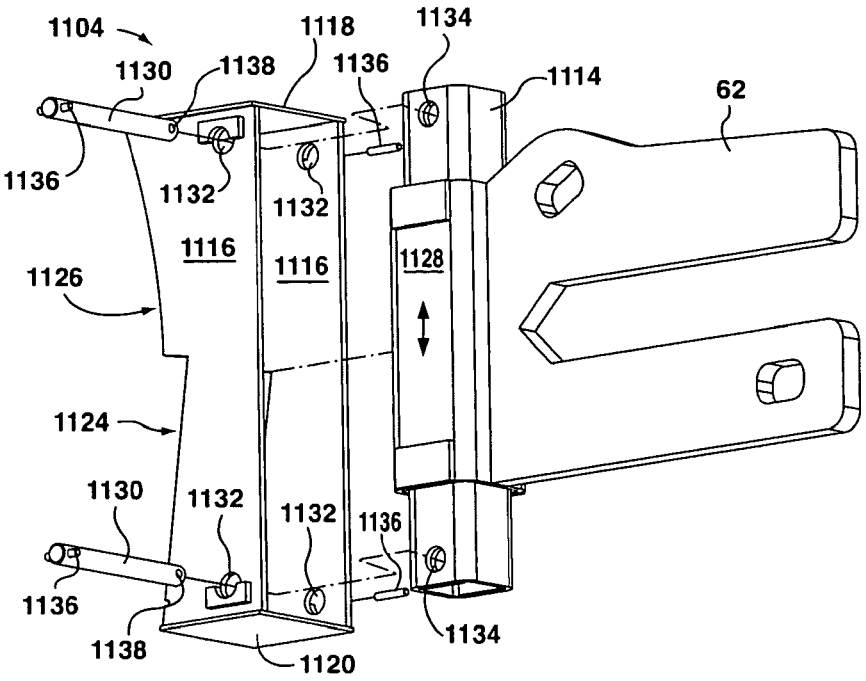
FIG. 12A is an exploded isometric rear view of the vehicle mount of FIG. 11A.
Figure 12B:
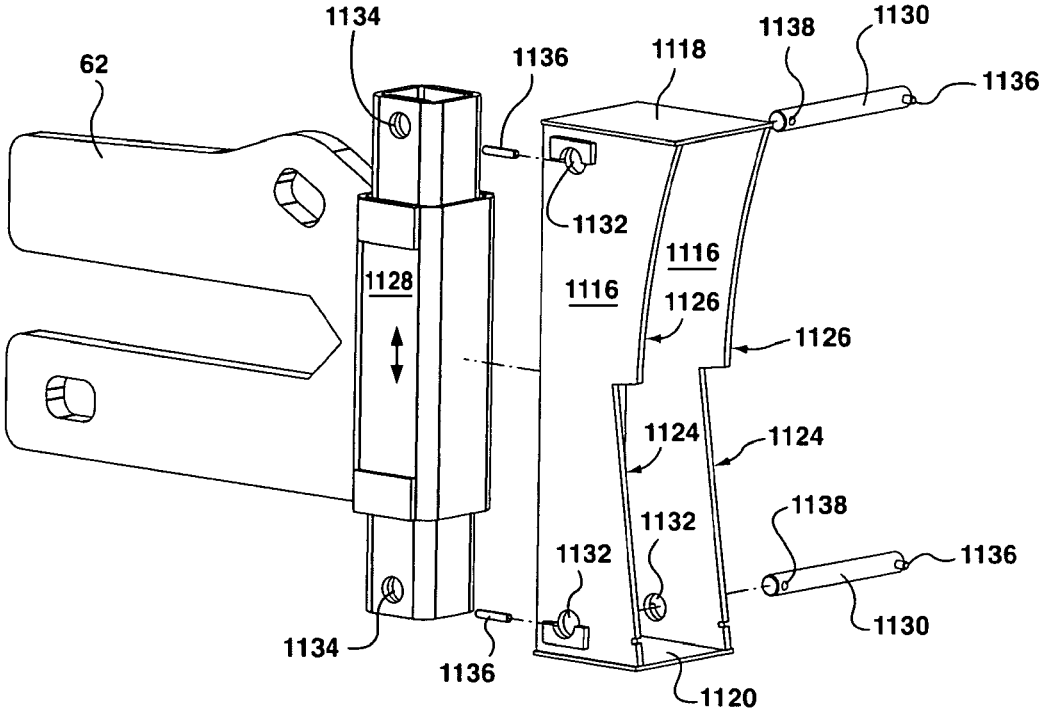
FIG. 12B is an exploded isometric front view of the vehicle mount of FIG. 11A.

Referring now specifically to FIGS. 12A and 12B, the vehicle mounts 1104 are assembled by sliding the sleeve 1128 of the receiver 62 onto the guide shaft 1114 and then inserting the guide shaft 1114 into the support frame 1110 between the mounting plates 1116 and the top and bottom plates 1118, 1120. Mounting rods 1130 are then slid through opposed reinforced mounting apertures 1132 defined at opposite ends of the mounting plates 1116 and through correspondingly positioned shaft apertures 1134 defined through the guide shaft 1128 at opposite ends thereof. The mounting rods are then secured in position by locking pins 1136 that are friction fit into rod apertures 1138 at opposite ends of the mounting rods 1130. The mounting rods 1130 limit the range of motion of the sleeve 1128 along the guide shaft 1114, and hence limit the range of motion of the receiver 62.

The exemplary vehicle mounts 1104 shown in FIGS. 2, 4 and 5 and in FIGS. 11A to 11C and 12A and 12B enable the receivers 62 to be easily replaced with receivers of a different type. By removing the mounting rods 1130 and then removing the guide shafts 1114 from the support frames 1110, the receivers 62 can be slid off of the guide shafts 1114 and new receivers having appropriate sleeves can be slid onto the guide shafts 1114. The guide shafts 1114 can then be placed back into their respective support frames 1110 and secured in place with the mounting rods 1130 and locking pins 1136, and the new receivers will thus be slidably mounted to the snow plow 10.

Figure 13:
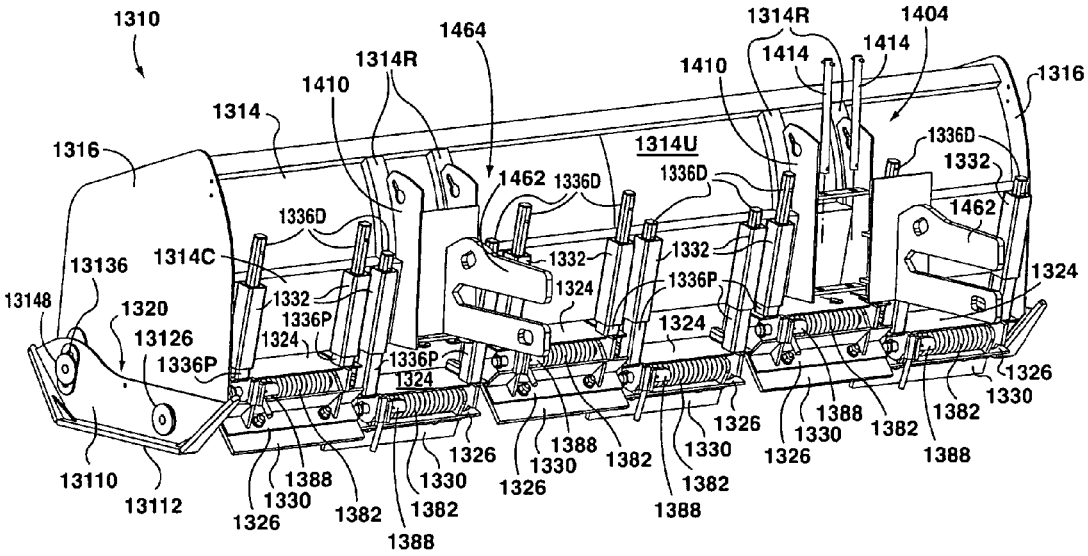
FIG. 13 is a partially exploded isometric rear view of a second exemplary embodiment of a snow plow according to an aspect of the present invention showing the surface-engaging sections thereof and the trip-blade portions of the surface-engaging sections in various positions.

FIG. 13 shows an alternate embodiment 1310 of a snow plow. The snow plow 1310 shown in FIG. 13 is similar to the snow plow 10 shown and described in respect of FIGS. 1 to 12B except that the snow plow 1310 in FIG. 13 is smaller, and uses a different adjustable vehicle mounting assembly. For example, the snow plow 1310 shown in FIG. 13 might be pushed by a skid-steer vehicle instead of a front end loader. Corresponding reference numerals are used in FIG. 13 to refer to features that are common to both the snow plow 1310 shown in FIG. 13 and the snow plow 10 shown and described in respect of FIGS. 1 to 12B, except with the prefix "13". The vehicle mounting assembly for the snow plow 1310 shown in FIG. 13 is indicated generally by the reference numeral 1404.

The vehicle mounting assembly for the snow plow 1310 shown in FIG. 13 comprises a pair of longitudinally spaced vehicle mounts 1404 mounted on the pushing face 1314U of the moldboard 1314. Each vehicle mount 1404 comprises a support frame 1410 secured on the pushing face 1314U of the moldboard 1314, two spaced-apart parallel guide shafts 1414 carried by the support frame 1410, and a vehicle receiver 1462 that slides non-rotatably along the guide shafts 1414 and can be secured to a plowing vehicle (not shown).

Figure 14A:
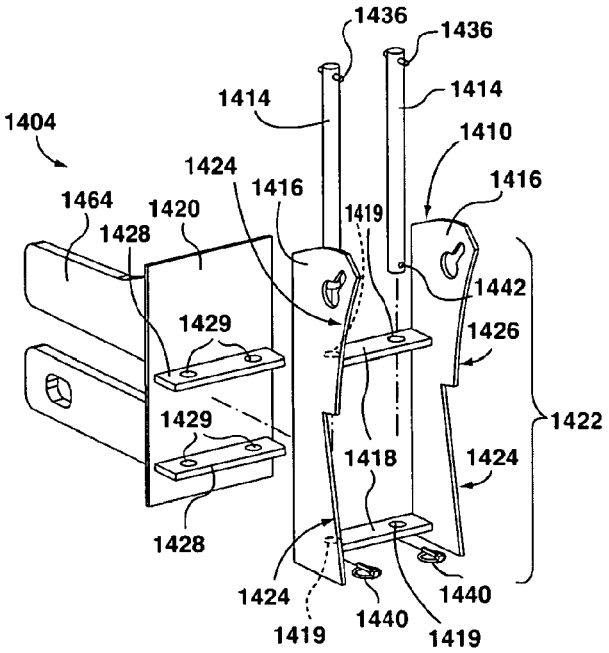
FIG. 14A is an exploded isometric front view of a vehicle mount of the snow plow of FIG. 13.
Figure 14B:
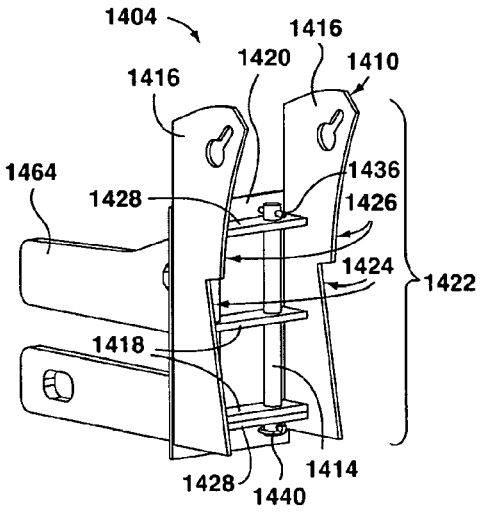
FIG. 14B is an assembled isometric front view of the vehicle mount of FIG. 14A.

FIGS. 14A and 14B illustrate construction of the vehicle mounts 1404 shown in FIG. 13. Each support frame 1110 comprises a pair of opposed, spaced-apart mounting plates 1416 secured to one another by a pair of parallel, spaced-apart crossbars 1418 extending between the mounting plates 1416. The mounting plates 1416 have a contoured mounting edge 1422 comprising a push channel edge portion 1424 shaped to match the contours of the reinforced push channel 1314C on the lower portion of the moldboard 1314, and an upper moldboard edge portion 1126 shaped to match the contours of the upper portion of the moldboard 1314 adjacent the push channel 14C, enabling the support frame 1310 to be mounted on the pushing face 1314U of the moldboard 1314. The crossbars 1418 have mounting apertures 1419 defined therein, with the mounting apertures 1419 in each crossbar 1418 being in registration with the mounting apertures 1419 in the other crossbar 1418. The guide shafts 1414 are mounted in the mounting apertures 1419 in the crossbars 1418, as described in greater detail below.

The receiver 1462 includes a generally planar guide plate 1420 that carries two spaced-apart, parallel guide bars 1428 having guide apertures 1429 defined therein, with the guide apertures 1429 in each guide bar 1428 being in registration with the guide apertures 1429 in the other guide bar 1428.

The vehicle mounts 1404 are assembled by aligning the receiver 1362 with the support frame 1410 so that the crossbars 1418 on the support frame 1410 and the guide bars 1428 on the receiver 1362 are parallel to one another, with the mounting apertures 1419 in each crossbar 1418 being in registration with the corresponding guide apertures 1429 in each guide bar 1428. The guide shafts 1414 are then slid through the mounting apertures 1419 and guide apertures 1429, and then secured in position by locking pins 1436 that are friction fit into rod apertures at one end of each guide shaft 1414 and by locating rings 1440 secured to apertures 1442 at the opposite end of each guide shaft 1414. The receiver 1462 can then slide along the guide shafts 1414, confined by the crossbars 1418, which will each intercept one of the guide bars 1428 and thereby limit the range of motion of the receiver 1462. The use of two guide shafts 1414 received in two spaced-apart guide apertures 1429 in each guide bar 1428 prevents the receiver 1462 from rotating.

Like the exemplary vehicle mounts 1104 shown in FIGS. 2, 4 and 5 and in FIGS. 11A to 11C and 12A and 12B, the exemplary vehicle mounts 1404 shown in FIGS. 13 and 14 enable replacement of the receivers 1462 with receivers of a different type. By removing the locating rings 1440 and then removing the guide shafts 1414 from the support frames 1410 and receivers 1462, the original receivers 1462 can be replaced with new receivers having appropriate guide bars, and the guide shafts 1414 then reinserted through the mounting apertures 1419 in the crossbars 1418 and through the guide apertures in the guide bars of the new receiver and secured in place with the locating rings 1430, thereby slidably mounting the new receivers to the snow plow 1310.

It will be understood that several variations within the scope of the appended claims may be made to the above-described embodiment of the invention as will be apparent to those skilled in the art.

The invention claimed is:

1. A snow plow having an adjustable vehicle mounting assembly, the snow plow comprising a main plow body comprising a moldboard having a plowing face and a pushing face opposed to the plowing face, the adjustable vehicle mounting assembly comprising:

two support frames carried by the pushing face of the moldboard, the support frames being longitudinally spaced from one another;

at least one guide shaft carried by each support frame;

the at least one guide shaft being substantially fixed relative to the support frames and the pushing face of the moldboard; and two vehicle receivers securable to a plowing vehicle, each vehicle receiver being slidably received on a corresponding at least one guide shaft and adapted for non-rotating, parallel linear movement along the respective guide shafts toward and away from a surface-engaging edge of the snow plow within a limited range of motion.

2. The snow plow of claim 1, wherein each support frame carries a single guide shaft of polygonal cross-section and the vehicle receiver includes a corresponding sleeve in which the guide shaft is received.

3. The snow plow of claim 1, wherein each support frame carries at least two spaced-apart guide shafts and the vehicle receiver includes at least one guide bar having corresponding spaced-apart guide apertures in which the guide shafts are received.

4. The snow plow of claim 2, wherein:

each support frame comprises a pair of opposed, spaced-apart mounting plates;

each guide shaft is disposed between a respective pair of mounting plates;

each guide shaft is secured by mounting rods extending through opposed mounting apertures defined at opposite ends of the respective mounting plates and through correspondingly positioned shaft apertures defined through the guide shaft at opposite ends of the guide shaft.

5. The snow plow of claim 4, wherein the mounting rods are removable and replaceable to permit removal of the guide shafts to enable the vehicle receivers to be replaced with different vehicle receivers.

6. The snow plow of claim 3, wherein:

each support frame comprises a pair of opposed, spaced-apart mounting plates;

each pair of spaced-apart mounting plates being secured to one another by a pair of parallel, spaced-apart crossbars extending between the mounting plates;

the crossbars having mounting apertures defined therein, with the mounting apertures in each crossbar being in registration with the mounting apertures in the other crossbar in the pair of crossbars;

the guide shafts being mounted in the mounting apertures in the crossbars;

the guide shafts being secured in position by locking pins that are friction fit into rod apertures at one end of each guide shaft and by locating rings secured to apertures at the opposite end of each guide shaft.

7. The snow plow of claim 6, wherein the locking pins are removable and replaceable to permit removal of the guide shafts to enable the vehicle receivers to be replaced with different vehicle receivers.

* * * * *